US005182936A

United States Patent [19]

Sartorio

[11] Patent Number: 5,182,936

[45] Date of Patent: Feb. 2, 1993

[54] PLATE BENDING MACHINE EQUIPPED WITH A PLATE CLAMPING MANIPULATOR AND A PLATE POSITION DETECTING DEVICE

[75] Inventor: Franco Sartorio, Turin, Italy

[73] Assignee: Amada Company, Limited, Japan

[21] Appl. No.: 731,005

[22] Filed: Jul. 16, 1991

Related U.S. Application Data

[63] Continuation of Ser. No. 489,875, Mar. 6, 1990, Pat. No. 5,058,406, which is a continuation of Ser. No. 302,668, Jan. 27, 1989, abandoned.

[30] Foreign Application Priority Data

Jan. 29, 1988 [IT] Italy ..... 67058 A/88
Jan. 29, 1988 [IT] Italy ..... 67059 A/88

[51] Int. Cl.[5] ..... B21D 43/11; B21J 13/12
[52] U.S. Cl. ..... 72/420; 72/422
[58] Field of Search ..... 72/9, 420, 461, 422; 83/419, 269, 367, 704, 708; 901/24; 414/590

[56] References Cited

U.S. PATENT DOCUMENTS 4,594,868 6/1986 Takeuchi et al. ..... 72/319
4,641,828 2/1987 Yajima ..... 83/367
4,706,491 11/1987 Sartorio ..... 72/9
4,827,757 5/1989 Sartorio ..... 72/420
5,005,394 4/1991 Sartorio et al. ..... 72/420
5,058,406 10/1991 Sartorio et al. ..... 72/422

FOREIGN PATENT DOCUMENTS 227528 10/1987 Japan ..... 72/420
130566 6/1989 Japan ..... 72/420
1303210 4/1987 U.S.S.R. ..... 72/461
2178987 2/1987 United Kingdom .

*Primary Examiner*—Robert L. Spruill
*Assistant Examiner*—Donald M. Gurley
*Attorney, Agent, or Firm*—Wigman & Cohen

[57] ABSTRACT

A press brake for bending plates. A press brake is provided for bending plates, including a pair of dies which act in mutual cooperation to bend a plate, a plate clamping manipulator which grasps and moves a plate which is to be placed in scheduled location with respect to the dies and a plate position detector mounted on the press brake in a specified positional relationship with respect to the dies, for detecting a position of the plate grasped by the manipulator, and a controller for controlling the manipulator in response to a signal from the plate position detector.

3 Claims, 15 Drawing Sheets

5
13
15
139
141
A
51,53
95

13
15

51,53

91,93
51,53

51,53

51,53
7

PLATE BENDING MACHINE EQUIPPED WITH A PLATE CLAMPING MANIPULATOR AND A PLATE POSITION DETECTING DEVICE

This is a continuation of co-pending application Ser. No. 07/489,875 filed on Mar. 6, 1990 now U.S. Pat. No. 5,058,406 which in turn is a continuation of Ser. No. 07/302,668 filed on Jan. 27, 1989 now abandoned.

BACKGROUND OF THE INVENTION

1. Field of the Invention

The present invention relates to a plate bending machine, and, in particular, to a plate bending machine such as a press brake provided with a manipulator capable of handling a plate which is subjected to a bending process in a bending machine, and to a plate bending machine provided with a plate position detecting device capable of detecting a position of the plate which is being handled by the manipulator and being subjected to the bending process.

2. Description of the Prior Art

Conventionally, a manipulator has been developed for automatically handling the workpiece in a plate bending machine such as a press, brake, where a plate bending operation is performed, in order to automate this process.

A conventional manipulator, which is usually equipped with an industrial robot, is generally set up in a specified position in front of the bending process machine. In this type of manipulator the arm is installed on a support column in a manner to allow both free vertical and rotary movement, and also to provide free telescopic motion, and rotation. A plate clamping device is provided on the end of the arm for freely grasping a workpiece.

In a conventional manipulator with the abovementioned configuration, for the plate clamping device to have a wide range of movement the arm must be long. Therefore, the overall configuration results in a large manipulator, which is a drawback. In addition, the positioning of a plate in the plate bending device of the plate bending process machine is performed entirely by the manipulator. It is therefore necessary to construct a high-precision manipulator to improve the precision of the positioning of the plate. This leads to the problem of excessively high production costs.

The inventor of the present invention, with due consideration to these problem areas, has disclosed in Japanese patent application No. Sho-62-313760 an improved manipulator for handling plate material in a plate bending machine such as the press brake described. This manipulator grasps the plate material and causes the clamped plate to rotate through 180 deg with respect to the plate bending machine. Accordingly, in the case where the plate is bent in more than one place, successive scheduled bending points can be provided to the plate bending machine, depending on the bending stage.

However, in carrying out a high precision bending process in such a bending machine, it is necessary for the plate to be accurately positioned with respect to the plate bending machine. In achieving such accurate positioning by means of the manipulator mechanism only, the problem arises that the manipulator must be constructed with an extremely big degree of precision. This, in turn, leads to the problem of an extremely high cost for the manipulator.

SUMMARY OF THE INVENTION

An object of the present invention is to provide, with due consideration to the drawbacks of such conventional devices, a plate bending machine which is capable of carrying out high precision plate bending even without a high degree of positioning precision by the manipulator.

This object is achieved in the present invention by the provision of a plate bending machine comprising a pair of dies which can act in mutual cooperation to bend a plate, a plate clamping manipulator which can grasp and move a plate which is to be placed in a scheduled location with respect to the dies, and a plate position detecting means mounted on the plate bending machine in a specified positional relationship with respect to the dies, for detecting a position of the plate grasped by the manipulator, and means for controlling the manipulator in response to a signal from the plate position detecting means.

By means of this configuration in the present invention, the plate provided by the manipulator is accurately positioned with respect to the dies.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

Figure 1:
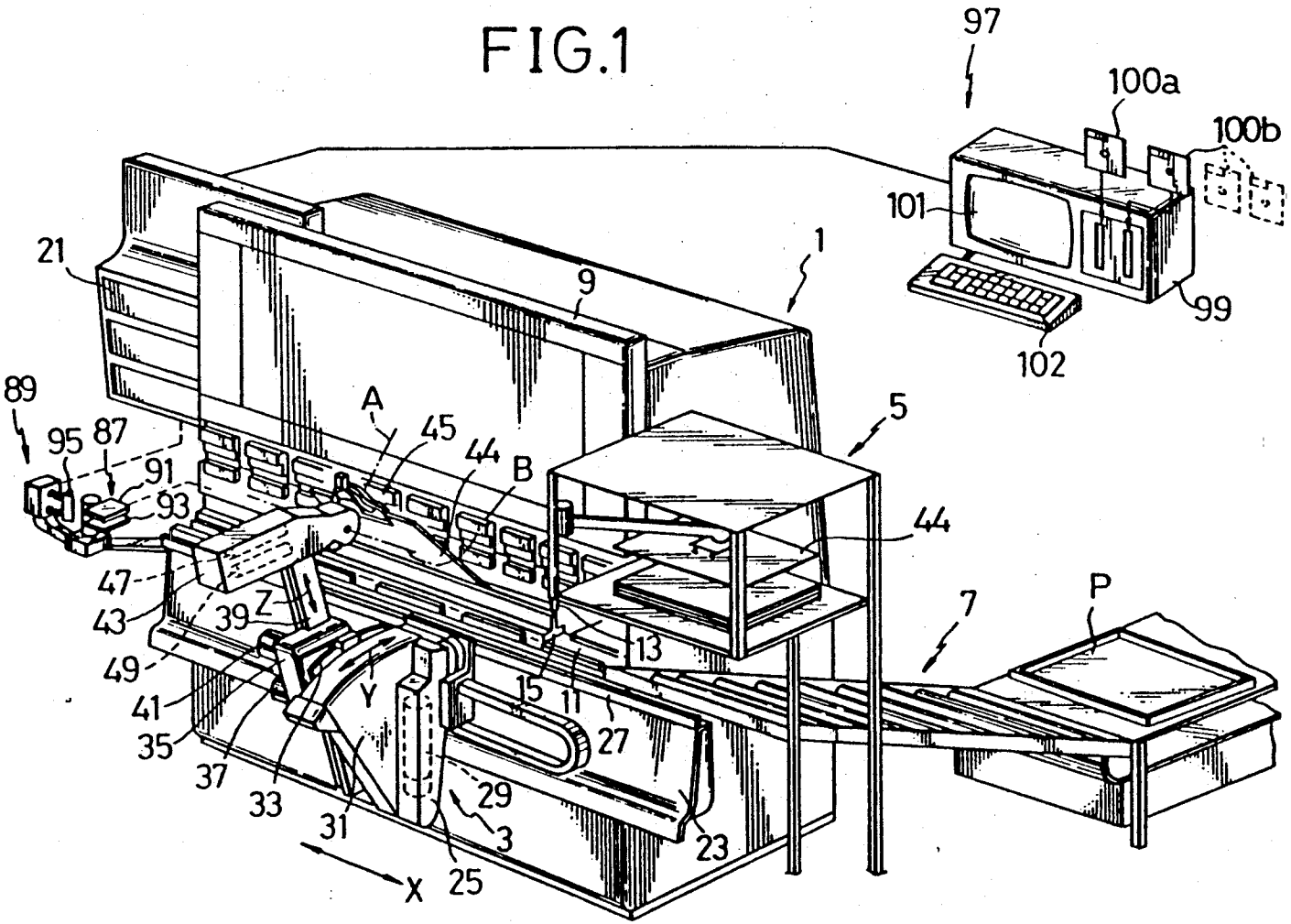
FIG. 1 is an explanatory drawing showing an embodiment of a plate bending machine of the present invention.

Now referring to FIG. 1, a manipulator 3 is mounted on the front side of a plate bending machine 1 which may be, for example, a press brake or the like. A magazine 5, in which a plate workpiece 44 is housed, is provided on the side of the plate bending machine 1. In addition, a transport device 7 for transporting a product P after bending to the next process is provided. The magazine 5 and the transport device 7 may be of a structure commonly used for such devices, therefore a detailed explanation is omitted.

The plate bending machine 1, in the same manner as the usual type of press brake, is provided with an upper frame 9 and a lower frame 11. An upper die 13 is mounted in a freely removable manner on the upper frame 9. In addition, a lower die 15 mounted on the lower frame 11.

As is commonly known, in the plate bending machine 1 with this type of configuration, one of the upper frame 9 and lower frame 11 can be elevated, and the bending operation of the workpiece 44 is carried out by the interposition of the workpiece 44 between the upper die 13 and the lower die 15 and by the subsequent engagement of the upper die 13 and the lower die 15.

Further, details have been omitted from the drawings, but, the configuration of this embodiment of the present invention is such that the lower frame 11 is elevated.

In addition, on the plate bending machine 1, a back gauge 17 which positions the workpiece 44 in the front-to-back direction (in FIG. 2, the left-to-right direction: the Y axis direction) is provided with free positional movement in the front-to-back direction. A plurality of sensors 19 are mounted in various positions on the back gauge 17 to detect contact with the workpiece 44. The sensors 19 are linear transducers with a comparatively long measurement stroke, similar, for example, to a direct acting potentiometer.

As a result of the above configuration, when the workpiece 44 is positioned by contact with the back gauge 17 previously positioned by a usual means, a determination is made as to whether or not the outputs of the sensors 19 in a plurality of positions match the prescribed output values. By this means it is known whether or not the edge of the workpiece 44 is parallel to the bending line of the upper and lower dies 13, 15 (hereinafter referred to as the bending axis C). Accordingly, it can be determined whether or not the workpiece 44 is in the correct position.

The output from the sensor 19 is input to a conventional numerical control device 21 mounted on the upper frame 9. The numerical control device 21 controls the operation of each working section of the plate bending machine 1 and the operation of the back gauge 17, as well as the operation of the manipulator 3. The output signals from the sensors 19 are input to the numerical control device 21 so that the operation of the manipulator 3 is controlled, and the output values of the sensors 19 reach the desired output values. In the present invention, the manipulator 3 is mounted on a base plate 23 which is integrally installed on the freely elevatable lower frame 11.

More specifically, the base plate 23 extends in the lateral direction (X-axis direction) along the longitudinal direction of the lower die 15. A first transfer block 25 is supported in a freely movable manner along the X-axis on the front surface of the base plate 23. A pinion (omitted from the drawings) which engages a rack rod 27 in the X-axis direction mounted on the base plate 23 is mounted in a freely rotatable manner on the first transfer block 25. A first servo motor 29 is provided for rotatably driving the pinion. The power transmission system by which the first servo motor 29 drives the pinion may be any normal configuration. A detailed explanation is therefore omitted. The first servo motor 29 may be, for example, a stepping motor or the like, and is provided with a position sensing device such as an encoder.

As a result of the above configuration, the first transfer block 25 can be moved in the X-axis direction by the operation of the first servo motor 29, and the position of the first transfer block 25 when moving in the X-axis direction can be detected by the position sensing device.

Figure 2:
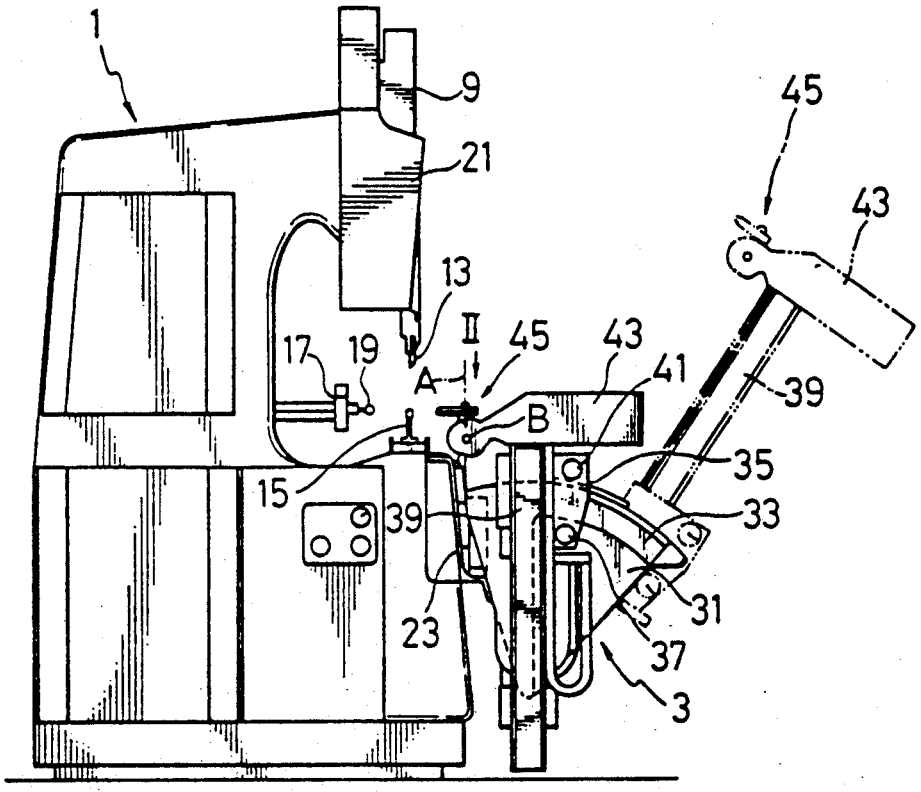
FIG. 2 is a side elevation of the plate bending machine of the present invention.

As is clearly shown in FIG. 1 and FIG. 2, a fan-shaped section 31 is provided, extending in the longitudinal direction (Y-axis direction) of the top section on the first transfer block 25. An arc-shaped rack member 33 is provided on the top of the fan-shaped section 31. A second transfer block 35 which is freely movable in the Y-axis direction along the rack member 33 is supported on the rack member 33. A pinion (omitted from the drawings) which engages the rack member 33 is provided in a freely rotatable manner, and a second servo motor 37 which rotatingly drives this pinion is installed on the second transfer block 35 The second servo motor 37 is provided with a position sensing device such as an encoder in the same way as with the first servo motor 29.

As a result of the above configuration, the second transfer block 35 is moved in the Y-axis direction in an arc along the rack member 33 driven by the second servo motor 37. The position of the second transfer block 35 in the Y-axis direction is detected by means of the position sensing device provided on the second servo motor 37.

As is clearly shown in FIG. 1 and FIG. 2, an elevating brace 39 which is freely movable in the vertical Z-axis direction is supported on the second transfer block 35, perpendicular to the direction of movement of the second transfer block 35. A rack is formed on in the vertical direction on the elevating brace 39. The pinion (omitted from the drawings) which engages this rack is supported in a freely rotatable manner on the second transfer block 35, and a third servo motor 41 is mounted on the second transfer block 35 in a manner to rotatably drive this pinion. The third servo motor 41 is provided with a position sensing device in the same way as with the second servo motor 29.

As a result of the above configuration, the elevating brace 39 is activated vertically, driven by the third servo motor 41, and the vertical position of the elevating brace 39 is known from being detected by the position sensing device.

An arm 43 extending in the Y-axis direction is suitably secured to the upper part of the elevating brace 39. A plate clamping device 45 is mounted on the tip of the arm 43 in a manner to freely grasp one side edge section of the workpiece 44. More specifically, as shown in FIG. 1 and FIG. 2, the plate clamping device 45 is provided in a manner to freely rotate in the vertical direction around a shaft B which is parallel to the X-axis. The plate clamping device 45 is also capable of freely rotating around a axis A which is perpendicular to the axis B.

A fourth servo motor 47 for rotating the plate clamping device 45 around the axis A, and a fifth servo motor 49 for rotating the plate clamping device 45 vertically around the axis B, are mounted on the arm 43. The fourth and fifth servo motors 47, 49 are each provided with a position sensing device in the same way as with the first servo motor 29. In addition, various types of mechanisms can be adopted as a power transmission mechanism for rotating the plate clamping device 45 around the axis A by means of the fourth servo motor 47, and as a power transmission mechanism for rotating the plate clamping device vertically by means of the fifth servo motor 49. Because these mechanisms have no special features a detailed description is omitted.

Figure 3:
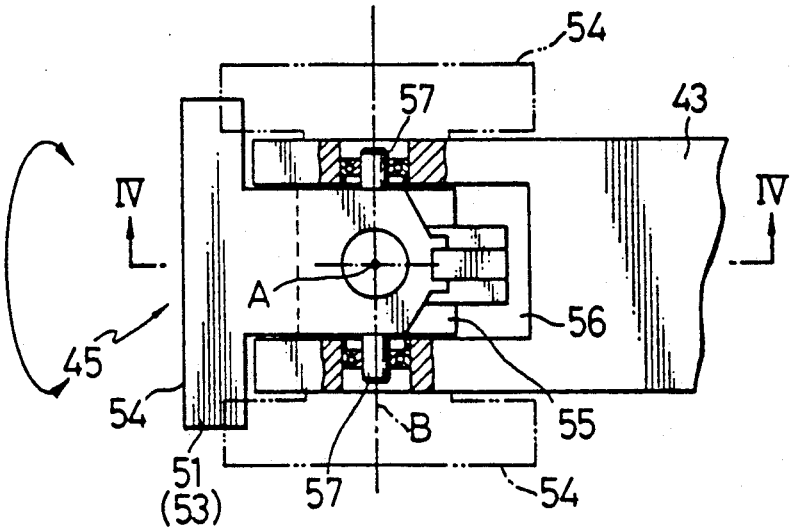
FIG. 3 is a plan view of part of a workpiece clamping device provided on a manipulator for the embodiment of the plate bending machine of the present invention.
Figure 4:
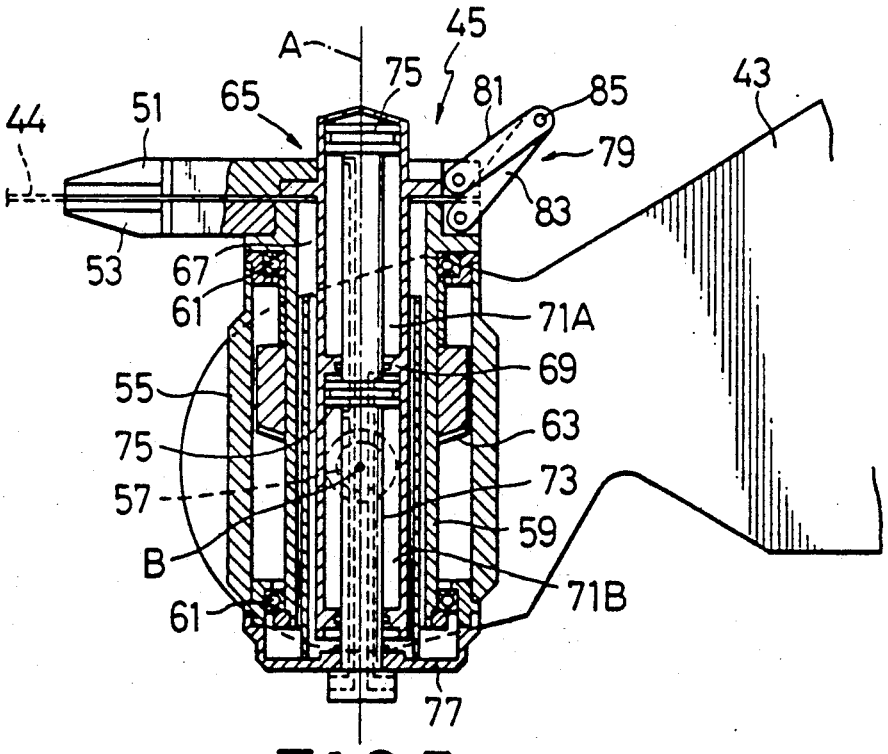
FIG. 4 is a side sectional drawing of the workpiece clamping device of FIG. 3.

As indicated in more detail in FIG. 3 and FIG. 4, the plate clamping device 45 is provided with an upper jaw 51 and a lower jaw 53 for grasping the workpiece 44. The upper jaw 51 and the lower jaw 53 are formed with a wide width plate clamping section 54 which clamps the workpiece 44, to have an almost T-shape. The jaws 51, 53 are supported in a freely reversing manner on a freely rotating sleeve 55 which rotates around the shaft B.

More specifically, the rotating sleeve 55, as clearly shown in FIG. 3, is positioned in a crevice-shaped concave section 57 formed at the tip of the arm 43. A pair of stub shafts 57 are provided, one on each side of the rotating sleeve 55 on the same centerline as the shaft B. Specifically, the rotating sleeve 55 is supported in a freely rotating manner on the tip of the arm 43 through the medium of the pair of stub shafts 57. Further, a chain sprocket or the like (omitted from the drawings) is provided on one of the pair of stub shafts 57. The chain sprocket receives motive power from the fifth servo motor 49.

As is shown in detail in FIG. 4, a tube 59 rotating in a direction at right angles to the shaft B is supported in a freely rotating manner through the medium of a plurality of bearings 61 on the inside of the rotating sleeve 55. The centerline of the rotating tube 59 coincides with the axis A. The lower jaw 53 is integrally mounted on the upper end of the rotating tube 59. A bevel gear 63 which receives motive power from the fourth servo motor 47 is integrally mounted on the rotating tube 59.

A linear motion type actuator 65 such as, for example, a cylinder actuator or the like is provided in the interior of the rotating tube 59. More specifically, a cylinder 67 is provided with free vertical activation. The upper jaw 51 is integrally mounted on the top of the cylinder 67. A vertical two-stage pressure chamber comprising a chamber 71A and a chamber 71B is formed by a dividing wall 69 inside the cylinder 67. The chambers 71A, 71B are engaged by a plurality of pistons 75 mounted on a piston rod 73 and are connected by a fluid channel formed in the piston rod 73. The lower part of the piston rod 73 is integrally mounted on a rod holder 77 which in turn is integrally mounted on the rotating sleeve 55.

In order to control the relative rotary motion of the upper jaw 51 and the lower jaw 53, the upper jaw 51 and the lower jaw 53 are mutually linked through the medium of a link mechanism 79. Specifically, as is clearly shown in FIG. 4, the end of a first link 81 of which the base is pivotally supported on the upper jaw 51, and the end of a second link 83 of which the base is pivotally supported on the lower jaw 51, are linked in a pivotally supported manner through a pin 85.

As a result of the above configuration, the upper jaw 51 can move up and down through the action of the actuator 65 and the workpiece 44 can be clamped between the upper jaw 51 and the lower jaw 53. Because the actuator 65 is provided with the upper and lower pressure chambers 71A, 71B, a comparatively large clamping force can be obtained even with a short stroke.

The upper and lower jaws 51, 53 can be rotated around the shaft A, driven by the fourth servo motor 47. As shown in FIG. 3, the plate clamping section 54 can be positioned in the longitudinal direction of the arm 43 as well as being positioned projectingly in the direction of both sides. Accordingly, when the plate clamping section 54 is in the state where it projects to the sides of the arm 43, the upper and lower surface of the workpiece 44 which is clamped in the plate clamping section 54 are reversed by the rotation of the rotating sleeve 55 around the shaft B.

Moreover, in the bending state on the workpiece 44 being bent by the upper and lower dies 13, 15, the plate end section clamped by the manipulator 3 can, for example, move upward with the plate clamping device 45 following this movement. Specifically, during processing, corresponding to the movement of the workpiece 44, the elevating brace 39 is elevated and the plate clamping device 45 is rotated downward around the shaft B.

Again referring to FIG. 1, an auxiliary clamping device 87 which freely grasps the workpiece 44 temporarily is mounted on one side section of the base plate 23 or the lower frame 11, and a side gauge device 89 is suitably mounted through the medium of a bracket.

An upper jaw 91 and a lower jaw 93 are provided on the auxiliary clamping device 87 to grasp the workpiece 44. The vertical movement of the upper jaw 91 is carried out in the same way as with the actuator 65 in the plate clamping device 15, by means of an actuator (omitted from the drawings). Accordingly, a detailed description of the action of the upper jaw 91 is omitted.

The side gauge device 89 is provided with a side sensor 95 and is used to detect the positional relationship of one side of the workpiece 44 which is clamped by the manipulator 3 and the plate clamping device 45. The side sensor 95, comprises a linear transducer such as a direct acting potentiometer, in the same way as the sensor 19 provided on the back gauge 17. The output value of the side sensor 95 is input to the numerical control device 21.

Accordingly, when one side edge of the workpiece 44 clamped in the plate clamping device 45 contacts the side sensor 95, and when the output value of the side sensor 95 is the stipulated output value, the position of the manipulator 3 in the direction of the X-axis is read by the numerical control device 21 from the detected value of the position detector device provided on the first servo motor 29. By comparing the detected value with the position output value of the base position when the workpiece 44 is not being clamped, the positional relationship in the X-axis direction of the side edge of the workpiece 44 clamped in the workpiece clamping device 45 and the manipulator 3 can be determined. Accordingly, with the side gauge device 89 as the base, the positioning of the X-axis direction of the workpiece 44 with respect to the upper and lower dies 13, 15 can be accurately performed.

Figure 5:
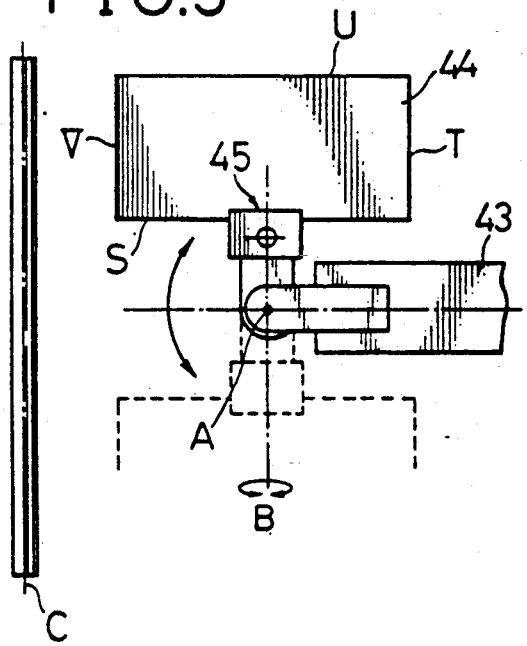
FIG. 5 to FIG. 9 are explanatory drawings of the action of the workpiece clamping device of the plate bending machine of the present invention.

As a result of the above configuration, as shown in FIG. 5, when the plate clamping device 45 is clamping the side S of a rectangular workpiece 44, the other three sides, T, U, V can be positioned with respect to the bending axis C by rotating the plate clamping device 45 around the axis A. Accordingly, it can be understood that the bending process on the three sides T, U, V can be performed consecutively. In addition, as shown in FIG. 5, when the plate clamping device 45 projects to the side of the arm 43, the workpiece 44 can be reversed in the vertical direction by rotation around the shaft B. Specifically, even the reverse bending of the workpiece 44 can be performed in sequence.

Figure 6:
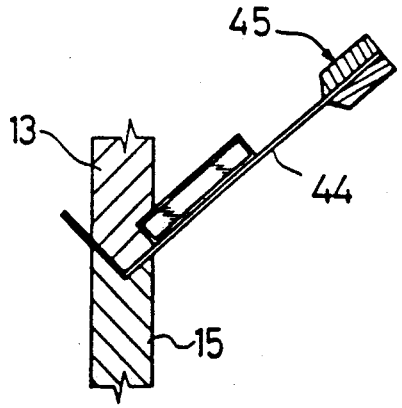
Figure 8:
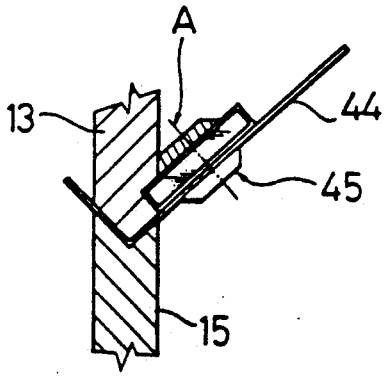
Figure 7:
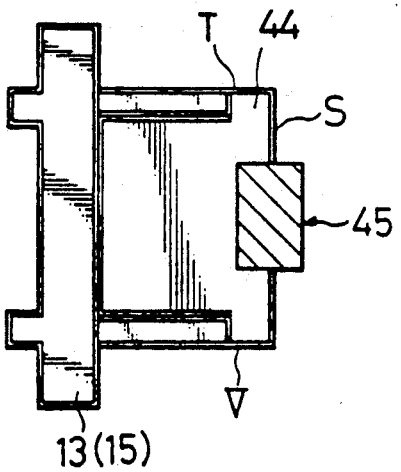
Figure 9:
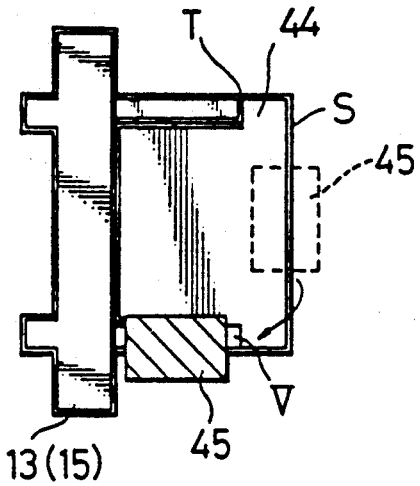

As outlined above, after the three sides T, U, V of the workpiece 44 have been bent, to bend the side S, as shown in FIG. 6 and FIG. 7, with the side U of the workpiece 44 interposed between the upper and lower dies 13, 15, as shown in FIG. 8 and FIG. 9, the workpiece clamping device 45 is moved to the T side or the V side, and the clamping of the workpiece 44 is improved. Then, by positioning the S side of the workpiece 44 on the bending shaft C, the bending of the side S can easily be carried out.

Furthermore, in the difficult case of improving the clamping when the workpiece 44 is interposed between the upper and lower dies 13, 15 and the dimensions of the workpiece 44 are comparatively small, the workpiece is moved to the position of the auxiliary clamping device 87, and the clamping of the workpiece 44 can be easily improved by temporarily clamping the workpiece 44 with the auxiliary clamping device.

Again referring to FIG. 1, a control device 97, such as a computer, for controlling the plate bending machine 1 and the manipulator 3 and the like through the numerical control device 21 is provided. The control device 97 comprises a central processing unit (CPU) 99, a display device 101, and a keyboard 102.

Also, the control device 97 is so constructed as to be capable of receiving data from storage mediums 100*a*, 100*b*, such as floppy disks, for controlling the CPU 99. The storage mediums comprise a system instruction storage medium 100*a* for storing instructions for the basic system of the control device 97, and a bending parameter storage medium 100*b* for storing bending parameters corresponding to a specific shape of a product. Here, the bending parameter storage medium 100*b* is prepared for each shape of product (however, parameters corresponding to the dimensions of the products is stored as free parameters). Therefore, the storage mediums are prepared as much as the number of desired shape of the products.

Figure 10:
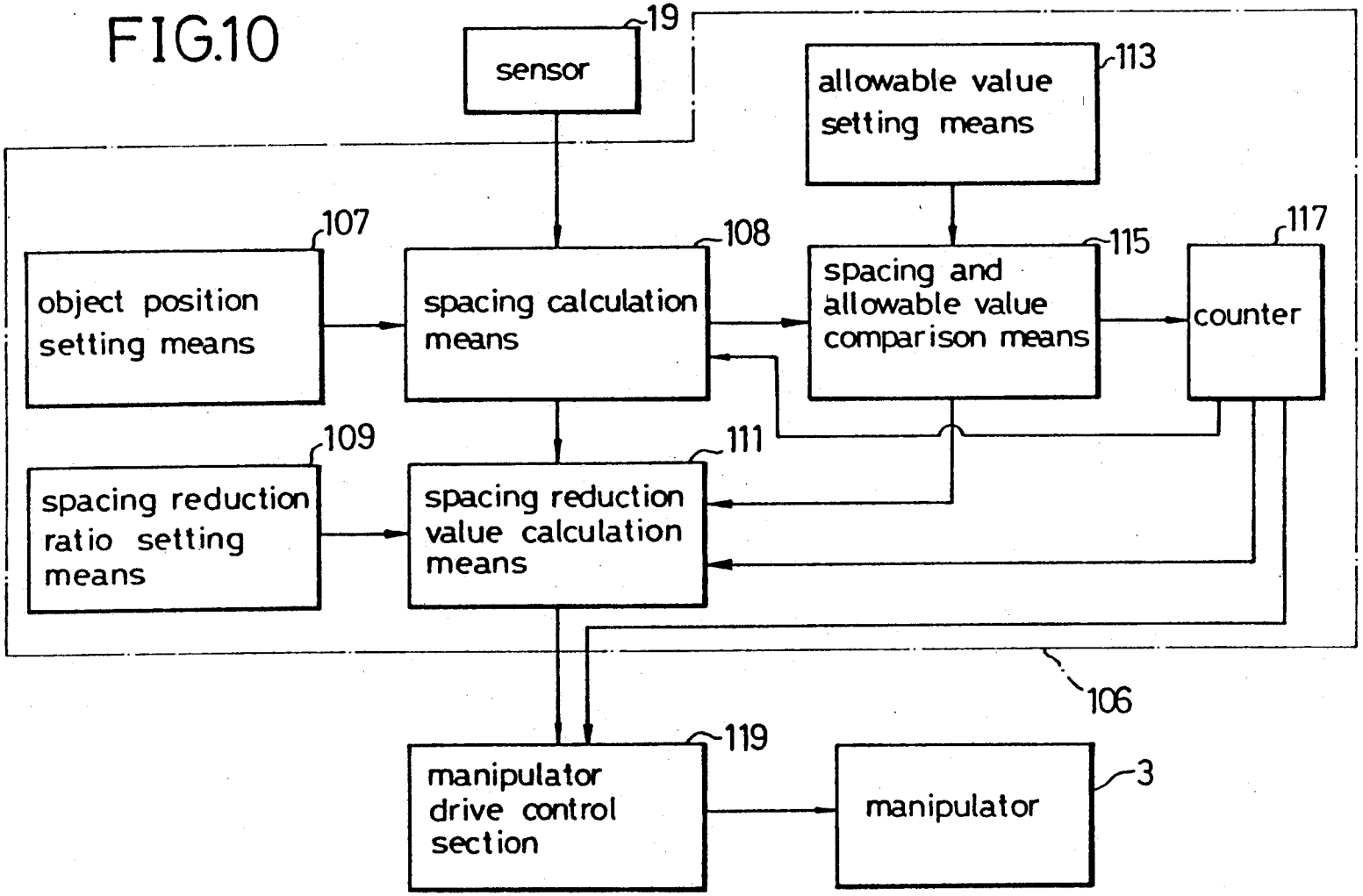
FIG. 10 is a block diagram of a first control device for controlling the manipulator to position the workpiece in the Y-axis direction.
Figure 11A:
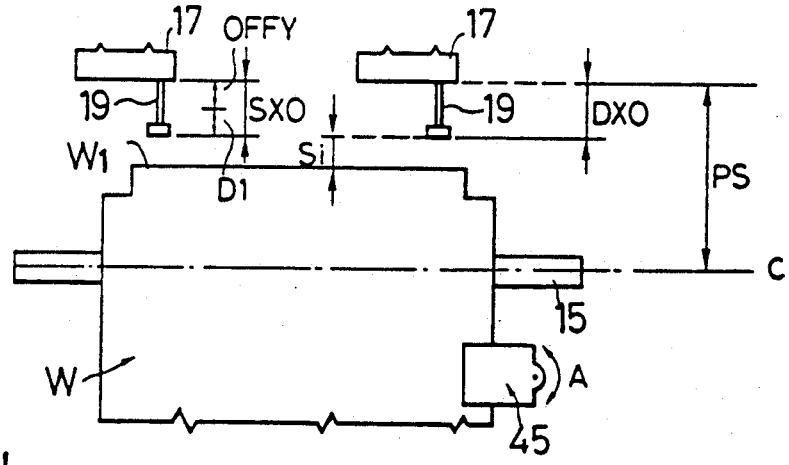
FIGS. 11*a*–11*c* are explanatory drawings of the positioning action by the first control device of the embodiment of the present invention.
Figure 11B:
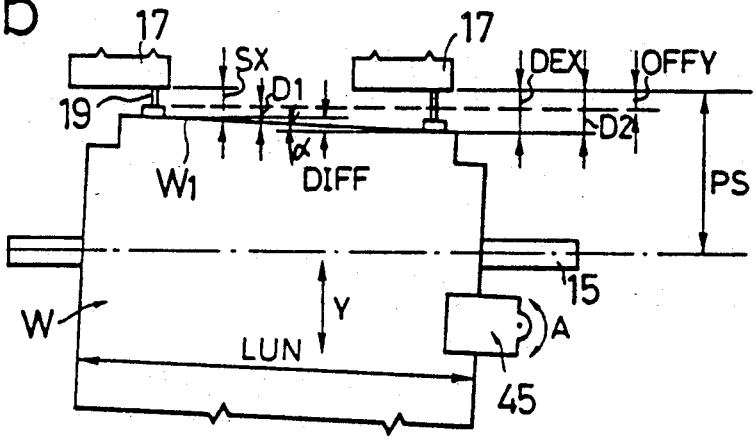
Figure 11C:
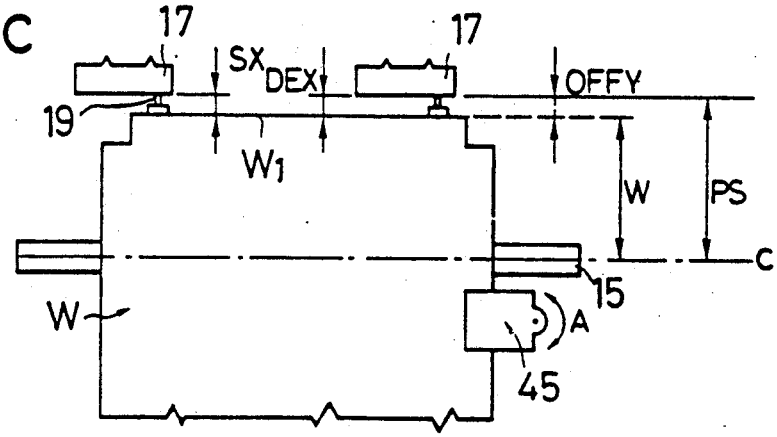

Now, refering to FIG. 10, in the numerical control device 21 or the CPU 99, first means for controlling the manipulator 3 in response to a signal from the sensor 19 of the backgauge 17 (as the plate position detection means) is provided to position the workplate W in Y-axis direction as shown in FIGS. 11*a*, 11*b* and 11*c*.

More specifically the first control means 106 comprises an object position setting means 107, a spacing calculation means 108, a spacing reduction ratio setting means 109, a spacing reduction value calculation means 111, an allowable value setting means 113, a spacing and allowable value comparison means 115, and a counter 117.

The object position setting means 107 sets an object position of the rear end edge of the plate where the positioning of the plate in Y-axis direction is performed. Here, the object position is represented by a projecting length OFFY of the sensor 19 as shown in FIGS. 11*a*, 11*b*, and 11*c*.

The spacing calculation means 107 first calculates the spacing D1, D2 for the current position, SX, DEX, and the object position OFFY of the right and left rear end edges of the plate when either one of the rear end edges touches the sensors 19, as shown in FIG. 11*b*. Then, the means 107 calculates the angle ALFA formed between the rear end edge W1 and bending axis C, and mean spacing YM as follows:

$$ALFA = \frac{DEFF}{LUN}$$

$$YM = \frac{D1 + D2}{2}$$

where DEFF (=D1−D2=) SX−DEX and LUN is the length of the workpiece W in the direction of the bending axis. Here it should be noted that the value of the angle ALFA is approximately equal that of the tangent thereof when it is represented by the radian unit because ALFA<<1.

The spacing reduction ratio setting means 109 sets the ratio KGY, KGA for which the spacing YM, ALFA calculated by the spacing calculation means 107 is reduced by a movement of the manipulator 3. This ratio KGY, KGA has a value smaller than unity such as ½, ⅓ or the like.

The spacing reduction value calculation means 111 multiplies the ratio KGY, KGA with the spacing YM, ALFA respectively to calculate the amount of linear movement of the manipulator 3 along Y-axis direction IAY and the amount of rotational movement thereof about A-axis IAA:

$$IAY = YM \times KGY$$

$$IAA = ALFA \times KGA$$

The allowable value setting means 113 sets the value YS, DIFFS allowed as the error for the positioning of the workpiece W in terms of the spacing YM and DIFF.

In addition, the spacing and allowable value comparison means 115 compares the spacing YM, DIFF and the allowable value YS, DIFFS and generates a signal when YM, DIFF is smaller than YS, DIFFS.

The counter 117 counts the number of times K in which the value YM, DIFF is smaller than the allowable value YS, DIFFS, and when this exceeds a specified value N, it outputs a positioning action stop signal to the spacing calculating means 108 spacing reduction calculator means 111 and manipulator 3.

A manipulator drive control section 119 drives and controls the manipulator 3 based on instructions from the spacing reduction value calculation means 111 and the counter 117.

Accordingly, as a result of this configuration, the workpiece W which is clamped in the manipulator 3 gradually approaches the object position (FIG. 11*c*) from the positioning action start status (FIG. 11*a*), through a plurality of approaching steps. And when the workpiece W approaches the object position through N times of approaching steps after the spacing YM, DIFF become smaller than the allowable value YS, DIFFS, it is assumed that the positioning has been completed with adequate accuracy, and the workpiece is stopped in that position (FIG. 11*c*).

Figure 12:
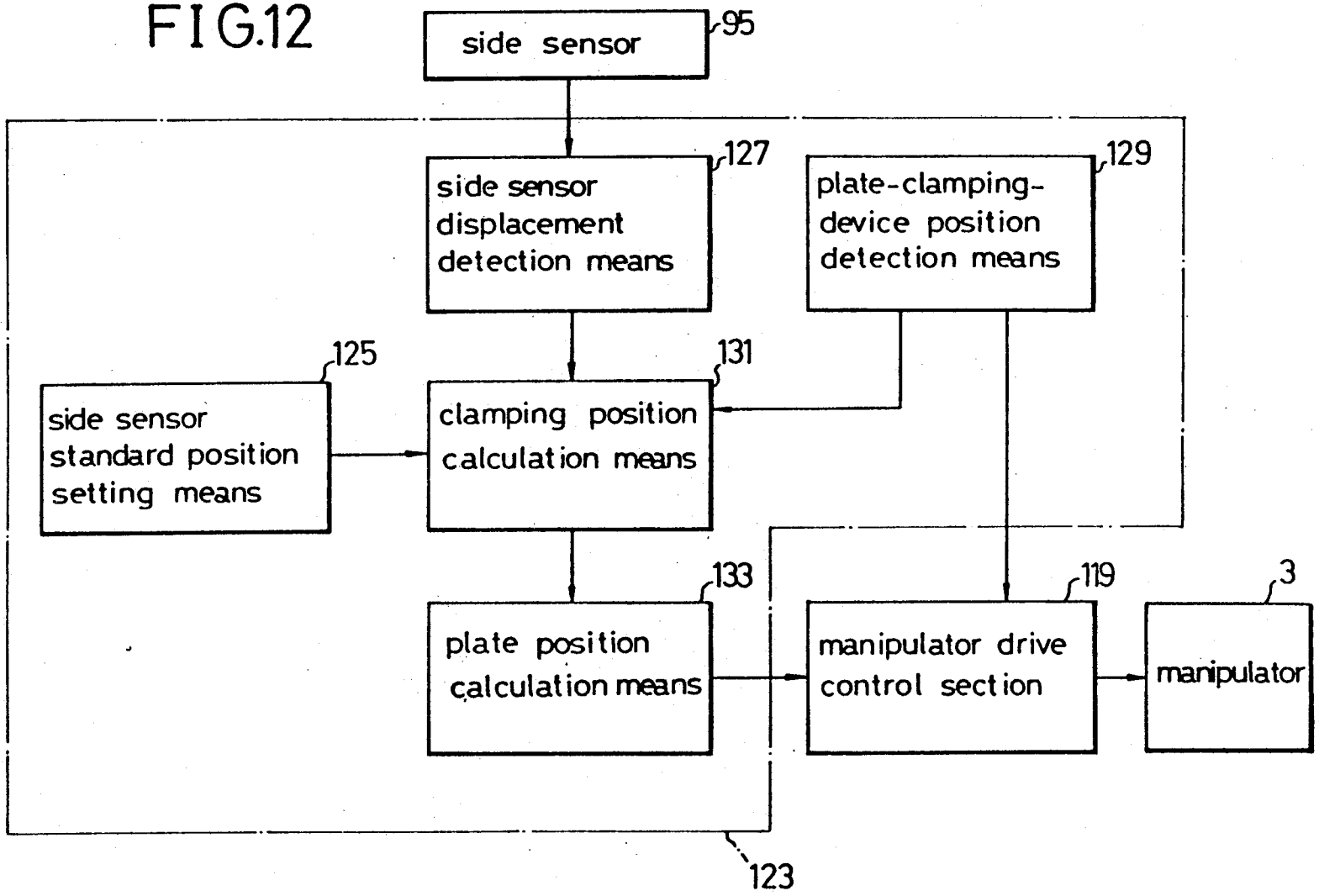
FIG. 12 is a block diagram of a second control device for controlling the manipulator to position the workpiece in X-axis direction.
Figure 13A:
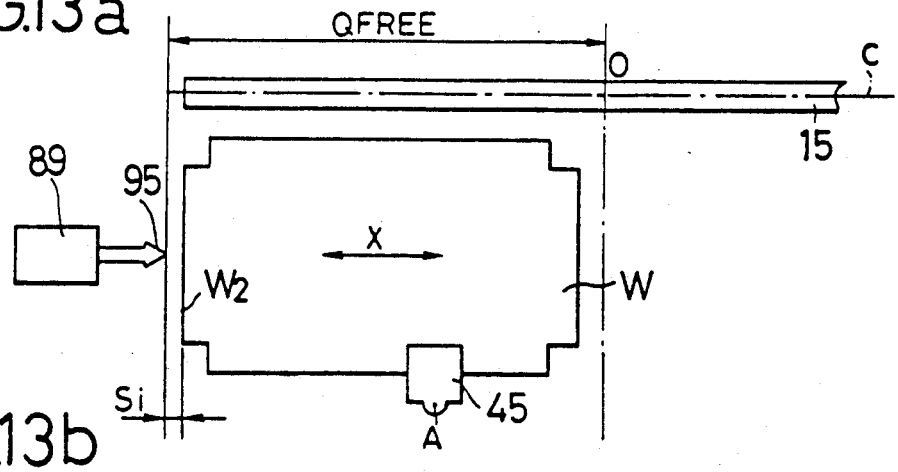
FIGS. 13*a*–13*c* are explanatory drawings of the positioning action of the second control device of FIG. 12.
Figure 13B:
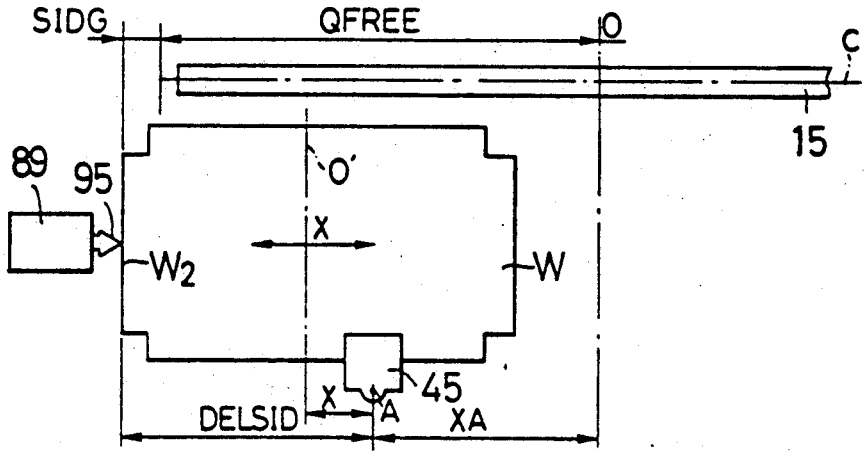
Figure 13C:
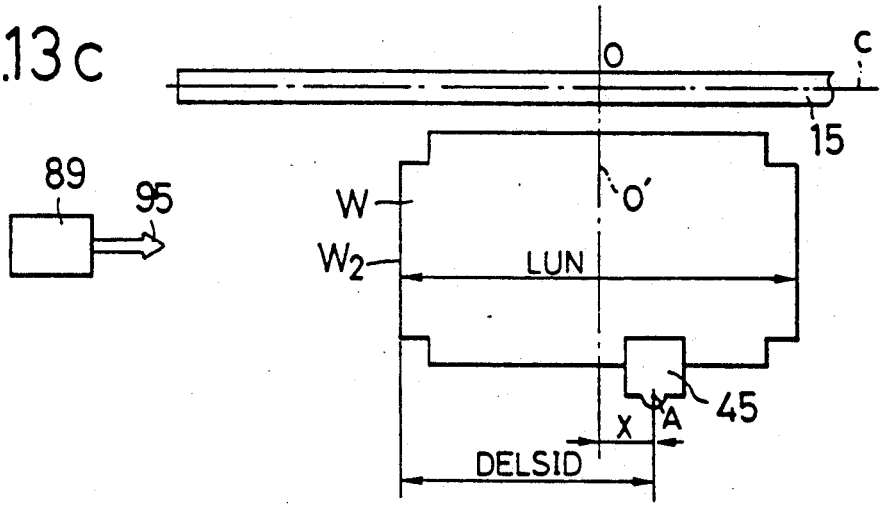

Now referring to FIG. 12, in the numerical control device 21 or in the CPU 99, a second means 123 for controlling the manipulator 3 in response to a signal from the side sensor 95 of the side gauge device 89 is provided to position the workpiece W in the X-axis direction as shown in FIGS. 13*a*, 13*b* and 13*c*.

More specifically, the second control means 123 comprises a side sensor standard position setting means 125, an side sensor displacement detection means 127, a plate-clamping-device position detection means 129, a clamping position calculation means 131, and a plate position calculation means 133.

More specifically, the side sensor standard position setting means 125, as shown in FIG. 13*a*, in the status where the workpiece W does not touch the side sensor 95, allots the distance QFREE from the center position 0 of the dies 15, 17 to the tip of the side sensor 95.

The side sensor displacement detection means 127, as shown in FIG. 13*b*, detects the amount of displacement SIDG of the side sensor 95 in the case where the workpiece W touches the side sensor 95.

The plate-clamping-device position detection means 129 calculates the distance XA from the center position of the die 15 to the A-axis of the plate clamping device 45, based on the signal from a position detection device provided on the first servomotor 29, as shown in FIG. 13*b*.

Then, the clamping position calculation means 131 calculates the distance DELSID=QFREE+-SIDG−XA between the plate side edge W2 and the A-axis of the plate clamping device, as shown in FIG. 13*b*, based on the distance QFREE, SIDG, XA. Also, based on the distance DELSID and the distance L/2 between the plate side edge W2 and the plate centerline 0', as shown in FIG. 13*b*, the distance between the pate centerline 0' and the A-axis, $$X=DELSID-L/2$$

is calculated.

The plate position calculation means 133 calculate the distance X+XA, from the centerline 0' of the workpiece W to the center position of the die 15, as shown in FIG. 13*c*, based on the output of the plate position calculation means 133.

Accordingly, the manipulator 3 is moved by a suitable amount in the X-axis direction through the manipulator drive control section 119, and the centerline 0' of the workpiece W coincides with the centerline 0 of the dies 13, 15, so that the workpiece W is positioned in the X-axis direction.

Figure 19:
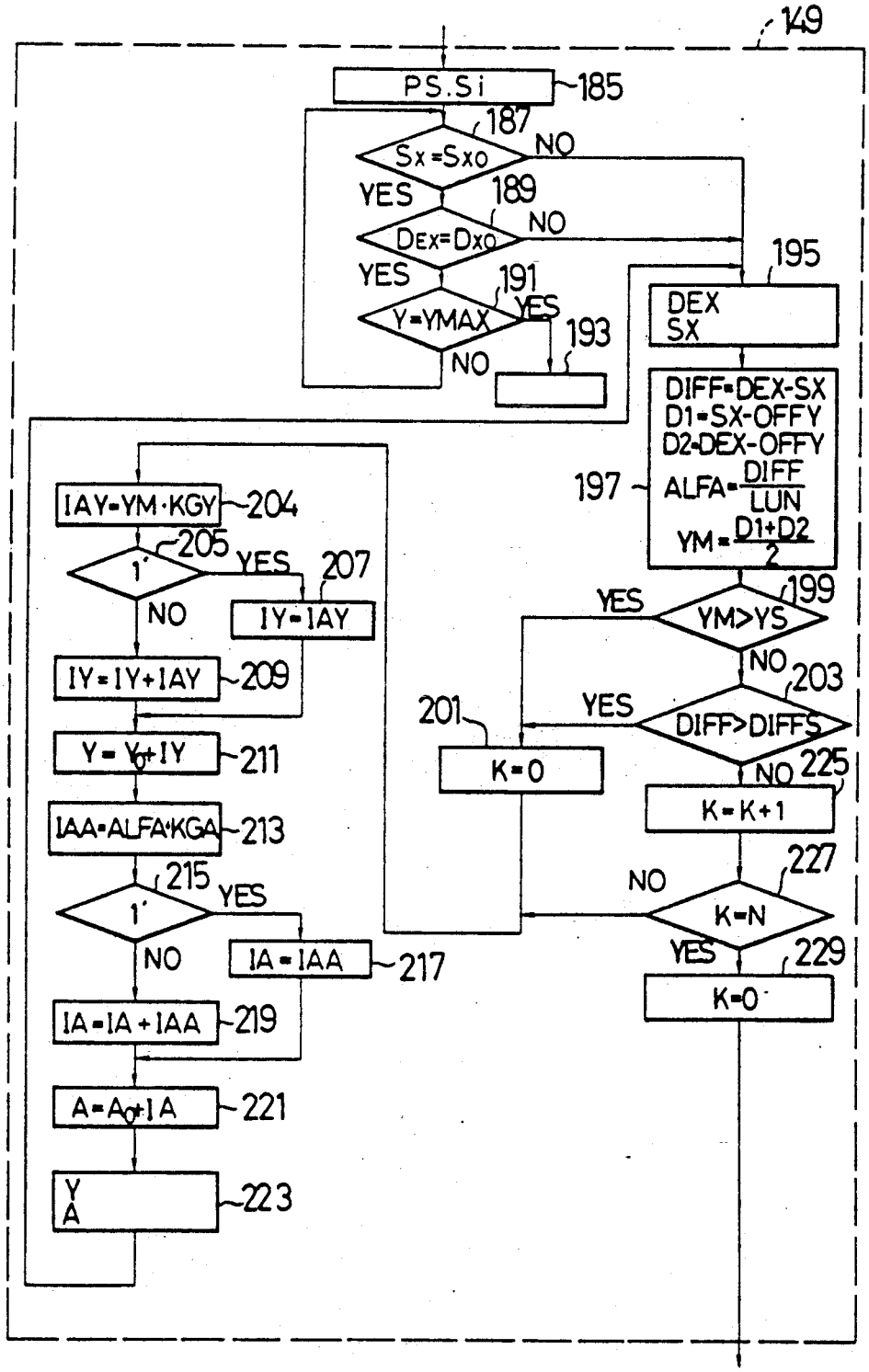
FIG. 19 an explanatory flowchart of the steps for positioning the workpiece in the Y-axis direction in FIG. 17.

Next, the bending process performed using the plate bending device of this embodiment of the present invention will be explained with reference to FIGS. 14*a*, *b*, and *c* through FIG. 19.

Figure 14A:
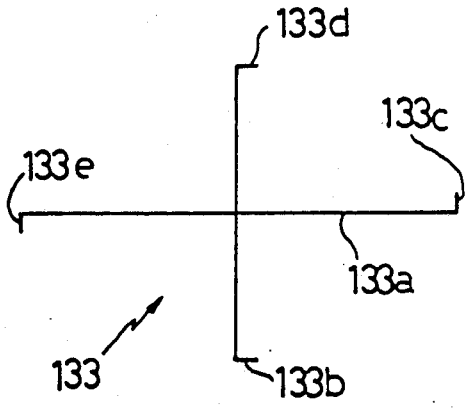
FIG. 14*a, b,* and *c* are explanatory drawings of the fabrication of a box by the plate bending machine of the present invention.

Now referring to FIGS. 14*a*, *b*, and *c*, one example of a product manufactured by the plate bending process of the present invention is demonstrated, for example, in the flanged boxes 133, 135, and 137. It is to be noted that the shape of the boxes in FIGS. 14*a*, *b*, and *c* is indicated by cross-sectional diagrams in both the longitudinal and lateral directions.

Figure 14B:
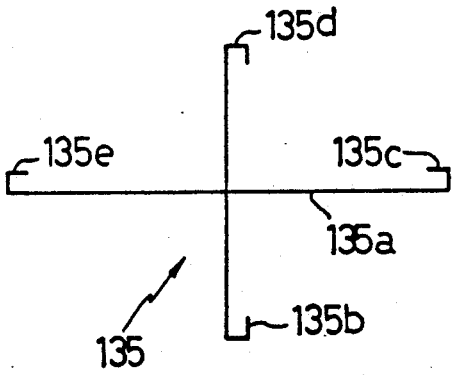
Figure 14C:
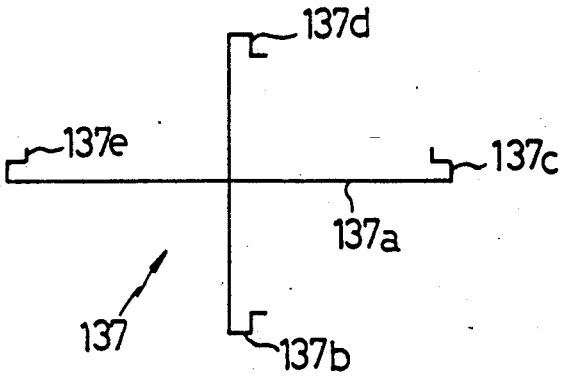

Specifically, on a box 133 shown in FIG. 14*a* a plurality of flanges 133*b*, 133*c*, 133*d* are formed, bent upward at 90 deg with respect to the bottom 133*a*, and a flange 133*e* is formed, bent downward 90 deg. On a box 135 shown in FIG. 14*b* a plurality of flanges 135*b*, 135*c*, 135*d*, 135*e* are formed, bent upward and inward at 90 deg each in two stages with respect to the bottom 135*a*. On a box 137 137*e* are formed, bent upward and inward at 90 deg each in two stages with respect to the bottom 137*a*, after which these flanges are again bent upward at 90 deg.

Next, an outline of the bending process for the box 135 will be explained with reference to FIGS. 15*a* to 15*i* and 15L–15Z.

Figures 15A, 15B, 15C, 15D, 15E, 15F, 15G, 15H, 15I, 15L, 15M, 15N, 15O:
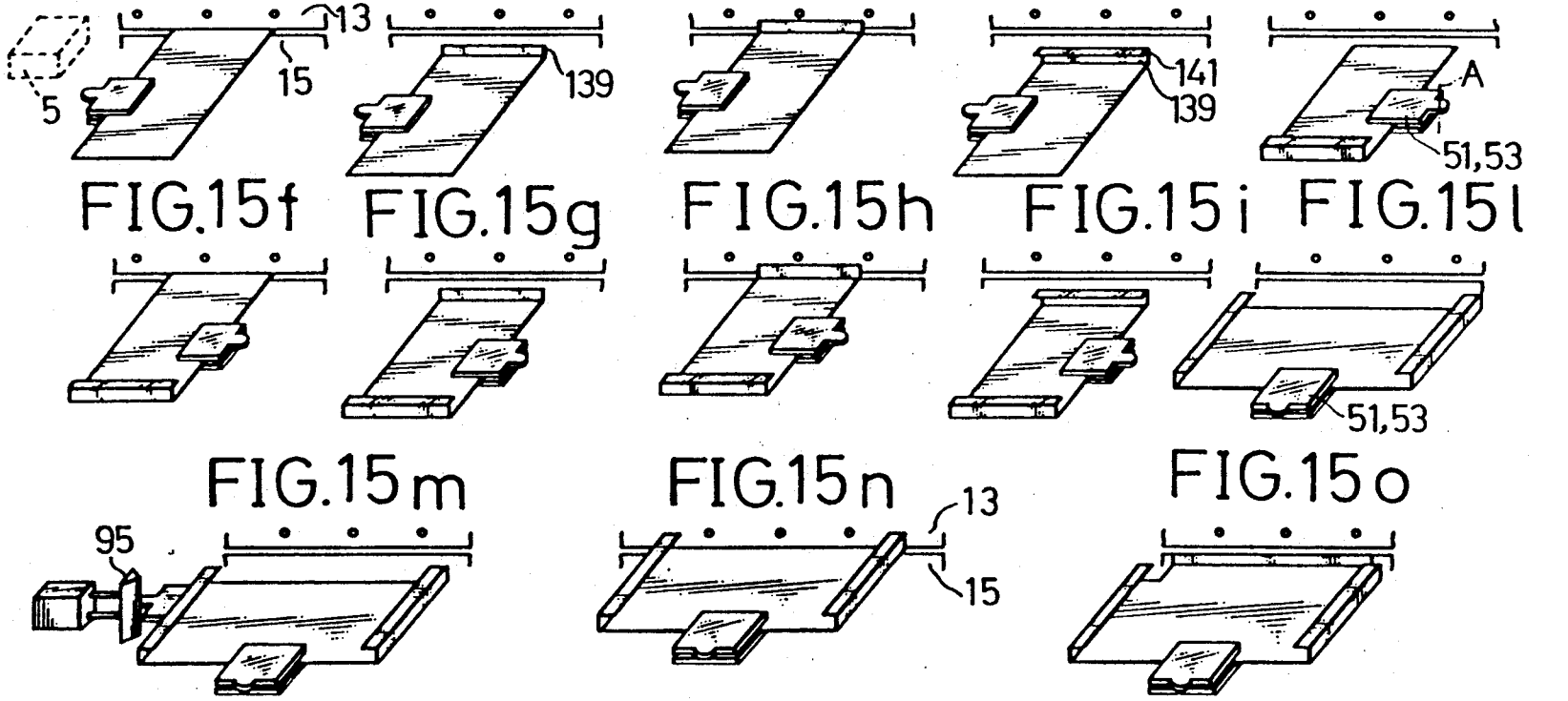
FIGS. 15*a*–15*i* and 15L–15Z are rough explanatory drawings of the bending process for fabricating the box shown in FIG. 14*b*.

First, the workpiece W is taken from the magazine section 5, the short side is inserted between the upper die 13 and the lower die 15 (FIG. 15*a*), and a flange 139 is processed (FIG. 15*b*).

Next, the short side of the workpiece W is again inserted between the upper die 13 and the lower die 15 (FIG. 15*c*) and a second flange 141 is processed (FIG. 15*d*).

Then, the jaws 51, 53 are rotated 180 deg around the A-axis (FIG. 15*e*) and the short side opposite the short side which was previously bent is bent twice in succession (FIG. 15*f*, *g*, *h*, *i*).

Following this, the jaws 51, 53 are rotated 90 deg around the A-axis (FIG. 15 1), after which the workpiece W is positioned by means of the side sensor 95, and revision of the height is performed as required (FIG. 15*m*).

Next, the free long side is inserted between the upper die 13 and the lower die 15 and is bent twice in succession (FIG. 15 *o*, *p*, *q*).

Figures 15P, 15Q, 15R, 15S, 15T, 15U, 15V, 15W, 15X, 15Y, 15Z:
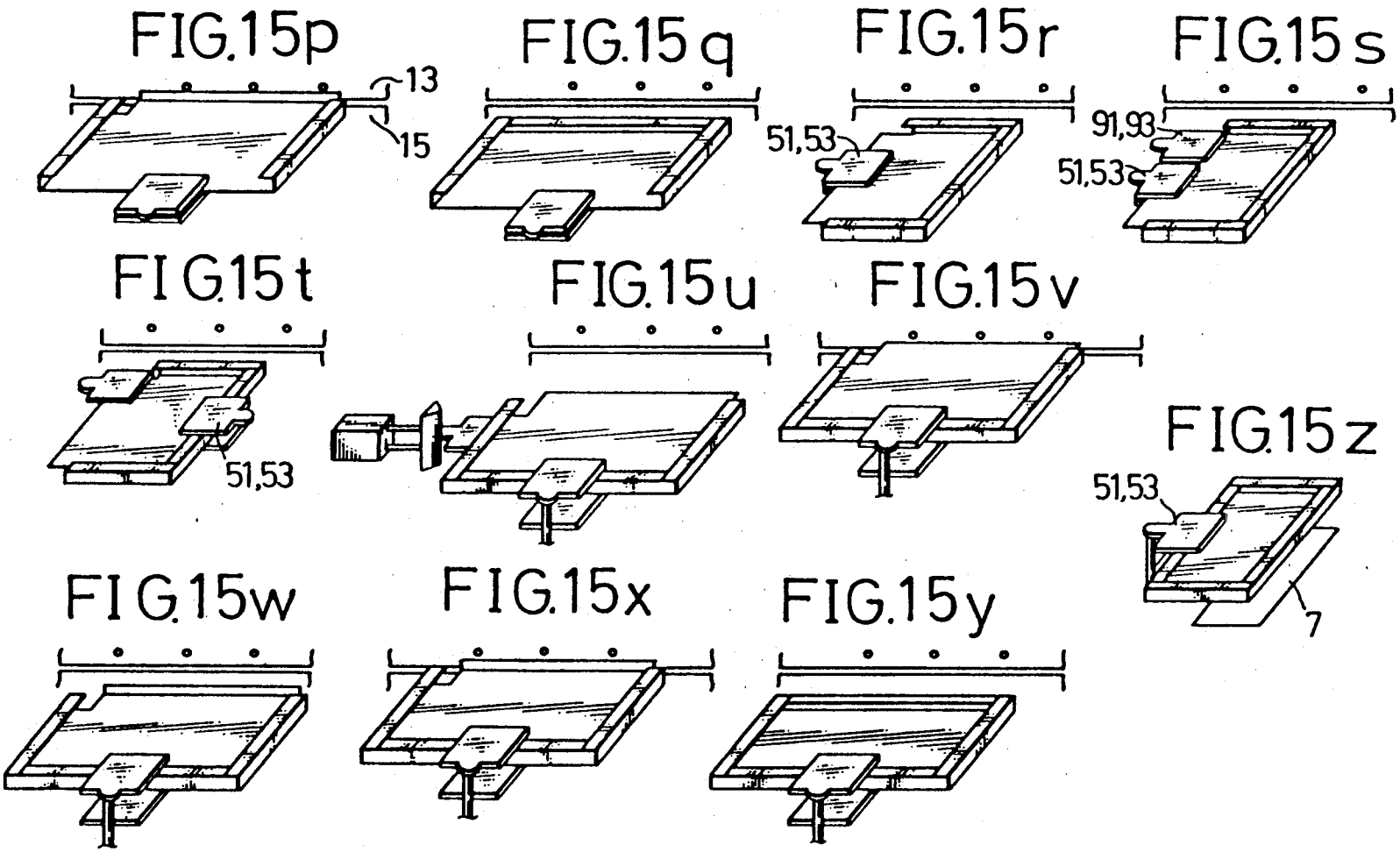
Figure 16:
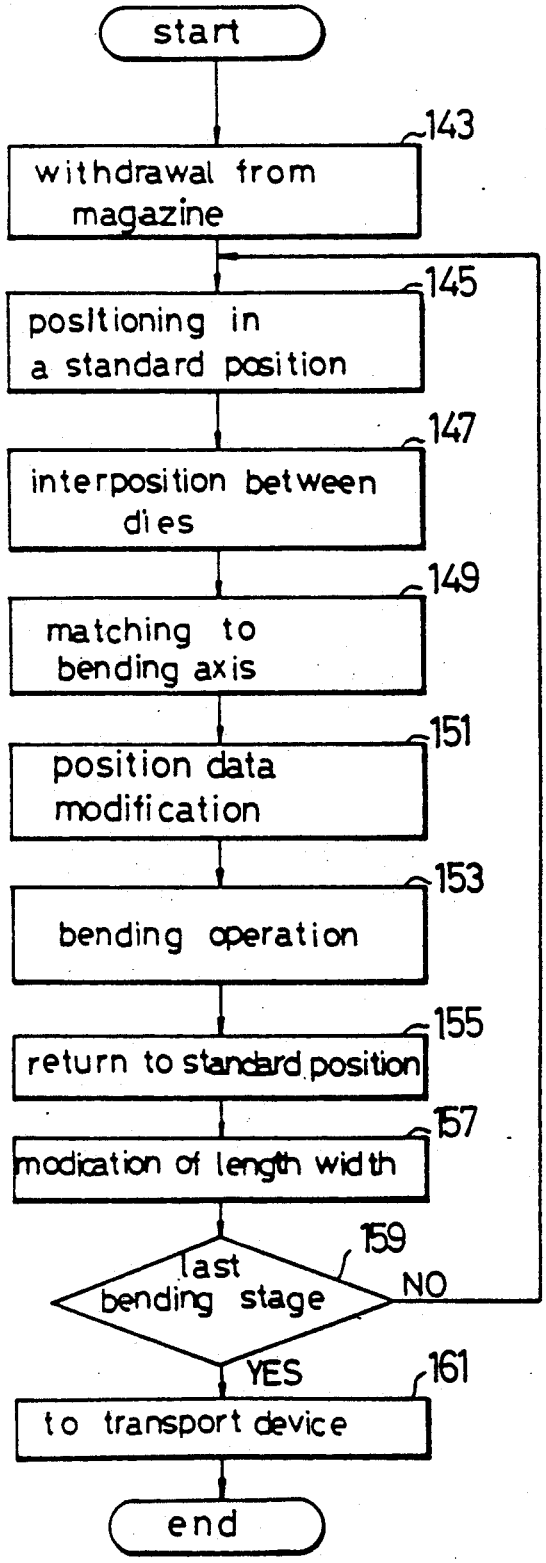
FIG. 16 is a flowchart of the bending process.

The jaws 51, 53 are then rotated 90 deg around the A-axis (FIG. 15*r*) and the same long side which is clamped in the jaws 51, 53 is clamped in the jaws 91, 93 of the auxiliary clamping device 87 (FIG. 15*r*).

Next, the jaws 51, 53 are temporarily removed from the workpiece W, are rotated 180 deg around the A-axis, and clamp the long side which has already been bent (FIG. 15*t*).

The jaws 91, 93 of the auxiliary clamping device 87 are then removed from the workpiece W and the jaws 51, 53 are rotated 90 deg around the A-axis, after which the workpiece W is positioned by means of the side sensor 95 and revision of the height is performed as required (FIG. 15*u*).

Following this, the free long side is inserted between the upper die 13 and the lower die 15 and is bent twice in succession (FIG. 15*v*, *w*, *x*, *y*).

Next, the jaws 51, 53 are rotated 90 deg around the A-axis and the product is discharged to the transport device 7 (FIG. 15*z*).

Next, the bending process, with emphasis on the positioning of the workpiece, will be explained in detail with reference to FIG. 16 to FIG. 19.

In step 143, as outlined above, the workpiece W is withdrawn from the magazine 5 by the manipulator 3.

In step 145, the workpiece clamping device 45 is rotated around the A- and B-axes, and the workpiece W is arranged in a specified standard position.

In addition, as will be explained in detail later, along with changing of the clamping position of the workpiece and the like, the workpiece W is positioned in the X-axis direction, as required.

In step 147, the workpiece W is inserted between the dies 13, 15. At this time, in order to prevent the workpiece W from impacting the dies, a specified height is maintained from the lower die 15 and the workpiece W is inserted between the dies 13, 15.

In step 149, as will be explained in detail later, the bending side of the workpiece W is adjusted to conform to the bending axis c of the dies 13, 15.

Figures 17A, 17B:
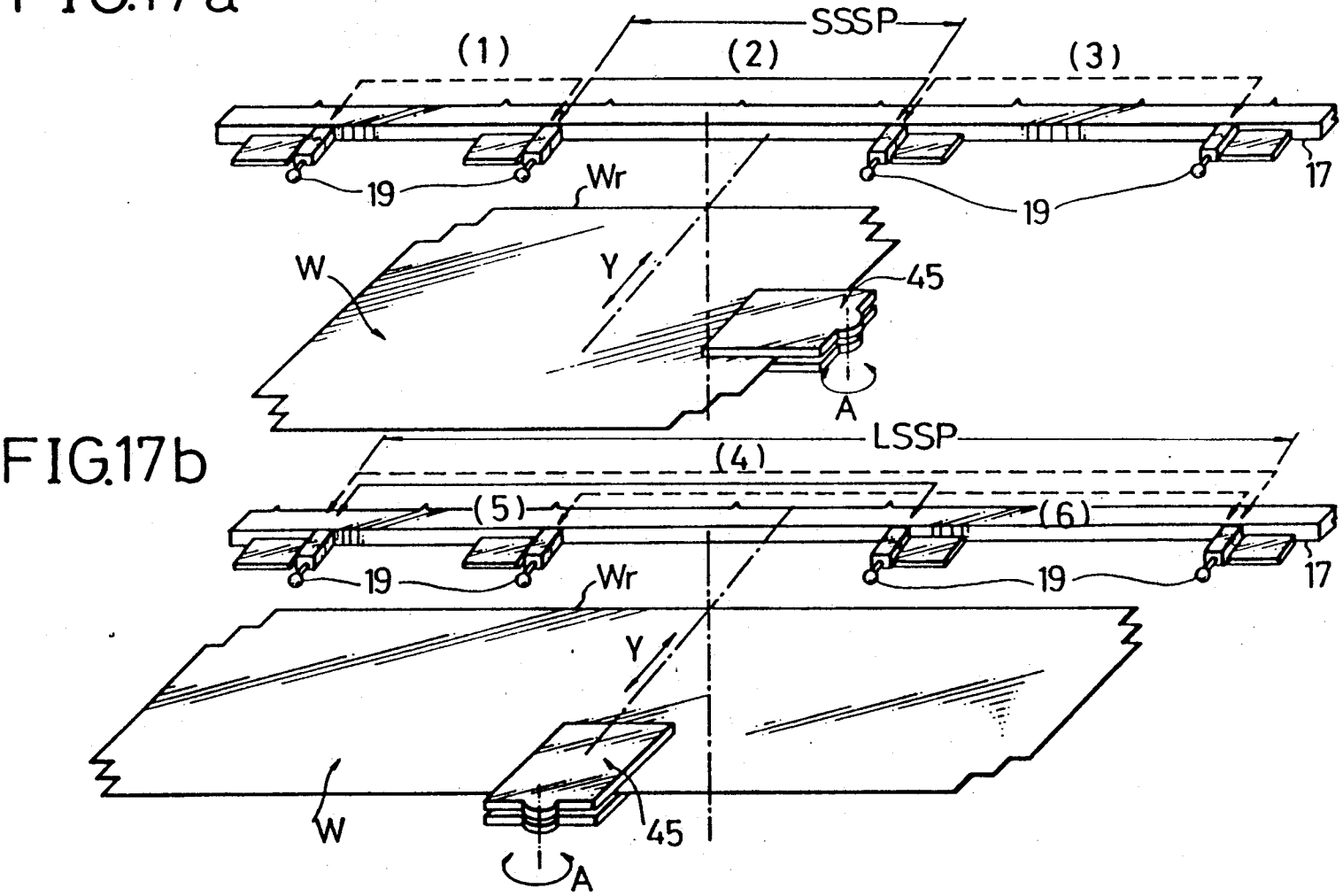
FIG. 17*a*, 17*b* is an explanatory drawing showing the method of using the sensor for positioning the workpiece for a step in FIG. 16.

Furthermore, at this time, as shown in FIG. 17*a*, in the case where the short side of the workpiece W is being bent, for example, among the sensors 19 provided on the back gauge 17, one pair of sensors 19 as represented by the coding (1), (2), or (3) is selected, and the workpiece W is positioned with respect to the dies 13, 15 according to the signal from the selected sensors 19. On the other hand, in the case where the long side of the workpiece W is to be bent, as shown in FIG. 17*b*, one pair of sensors 19 as represented by the coding (4), (5), or (6) is selected, and the workpiece W is positioned with respect to the dies 13, 15 according to the signal from the selected sensors 19.

In step 151, data representing the position of the workpiece W is modified based on the signal from the sensor 19, as required.

In step 153, in order to perform the bending process, the lower die 15 is moved. In addition, at this time, the manipulator 3 is moved to follow the movement of the edge of the workpiece W.

In step 155, after the bending process has been carried out, the workpiece clamping device 45 is returned to a specified base position.

In step 157, calculations are made to revise the height and width of the workpiece W. For example, in FIG. 15*b*, when the first flange 139 has been formed, the length of the workpiece W is decreased by the height of the flange only, while only the thickness of the workpiece W is increased, so that calculations are made to revise this balance.

In step 159, a check is made to determine whether or not the last bending stage has been performed. If additional bending remains, the program returns to step 145.

The loop from step 145 to step 159 is continued until all the bending steps have been performed, and when the final bending step has been completed, the program proceeds from step 159 to step 161.

In step 161, the finished product is discharged to the transport device 7 and the bending operation is completed.

Figure 18:
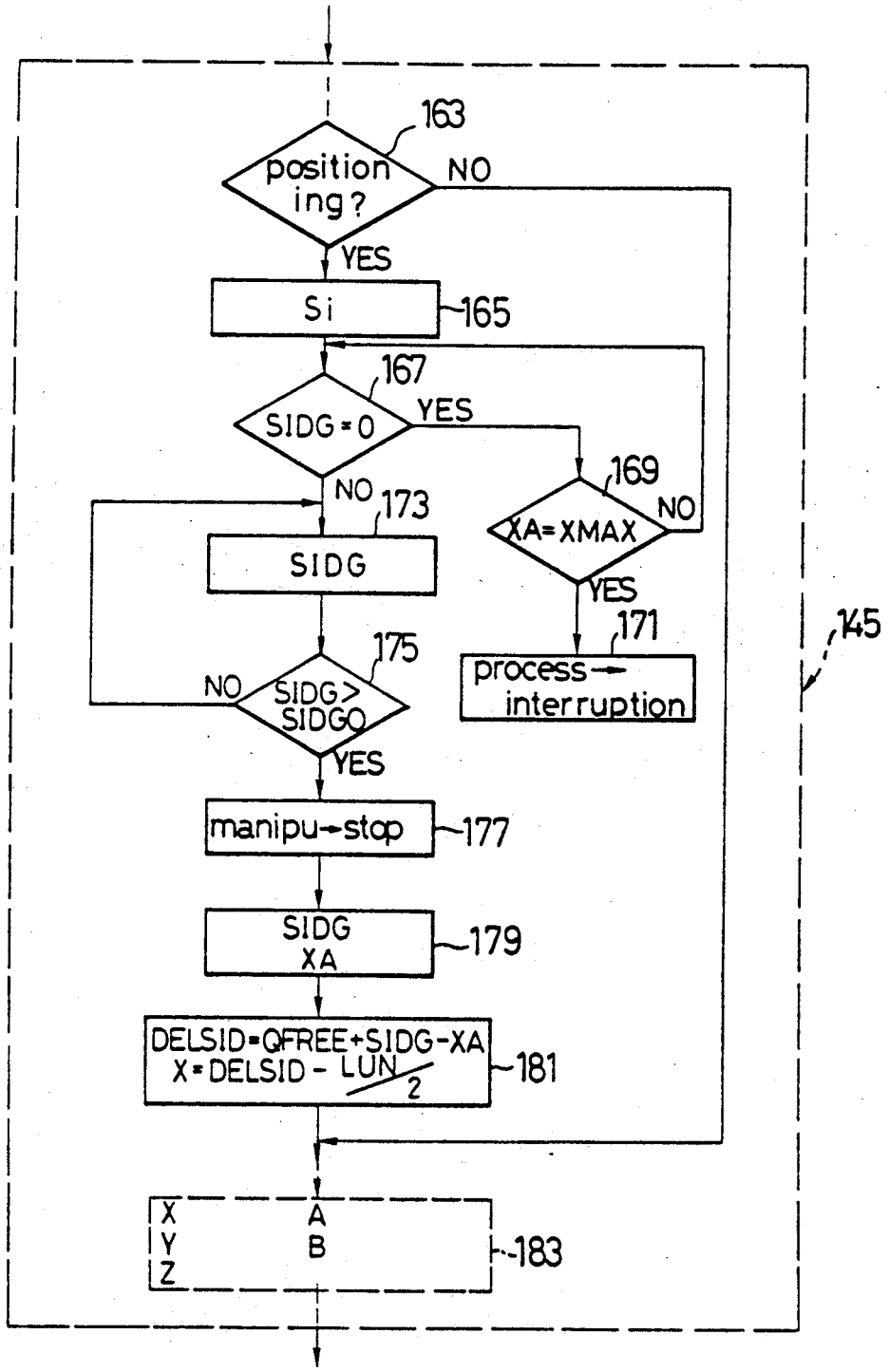
FIG. 18 is an explanatory flowchart of the steps for positioning the workpiece in the X-axis direction in FIG. 16.

Now referring to FIGS. 13, and 18, the operation for positioning the workpiece W in the X-axis direction in step 145 will be explained in detail.

In step 163, the determination is made as to whether or not it is necessary to position the workpiece W in the X-axis direction. For example, there is the case where the clamped side has been changed, as previously outlined, or the case where the process is transferred from bending the short side to bending the long side.

If the result of this determination is positive, the program advances to step 165. Here, the workpiece side edge W2 is, for example, Si=5 mm away from the end section of the side sensor 95, as shown in FIG. 13*a*.

In step 165, the manipulator 3 is moved in the X-axis direction and the workpiece W on the side sensor 95 side is transferred under the rule $Si=(\frac{1}{2})AT2$. Here, A is the acceleration of the manipulator 3 moving in the X-axis direction (for example, 700 mm/sec/sec), and T is the time of movement.

In step 167, a check is made to determine whether the displacement SIDG (see FIGS. 13*a*, 13*b*) of the side sensor 95 is zero or not. If the result is positive, the side edge W2 of the workpiece W is not yet touching the side sensor 95, so the program moves to step 169.

In step 169, a check is made to determine whether the position XA of the manipulator 3 on the X-axis is equivalent to the maximum possible value XMAX or not. In the case of a positive determination, this means that the workpiece side edge W2 passes over or under the edge sensor, or the sensor 95 has broken down. Therefore, the program proceeds to step 117, the bending process is interrupted, and an appropriate warning is given.

On the other hand, in the case of a negative determination, the program returns to step 167, and, while the manipulator 3 is being moved in the direction of the side sensor 95, a check is made to determine whether the side sensor displacement SIDG is zero or not.

Through the repetition of these actions the workpiece side edge W2 is made to touch the side sensor 95, the result in step 167 becomes negative, and the program proceeds to step 173.

In step 173, the side sensor displacement SIDG is detected, and the program proceeds to step 175.

In step 175, a check is made to determine whether or not the sensor displacement SIDG exceeds a specified value SIDO, set close to the center of the sensor action range. If negative, the program returns to step 173 and, while the manipulator 3 is moving in the direction of the side sensor 95, the side sensor displacement SIDG is detected.

If a positive determination is made at step 175, the program proceeds to step 177.

In step 177, the movement of the manipulator 3 is terminated.

In step 179, the movement XA of the manipulator 3 on the X-axis and the displacement SIDG of the side sensor 95 (as shown in FIG. 13*b*) are detected.

In step 181, the distance DELSID from the manipulator A-axis to the workpiece side edge W2 is calculated based on the movement XA and the displacement SIDG, as well as the distance QFREE from the center point 0 of the dies to the tip of the free side sensor, as shown in FIG. 13*b*:

$$DELSID=QFREE+SIDG-XA.$$

In step 181, based on the distance DELSID and the distance LUN/2 (where L is the width of the workpiece W in the X-axis direction) from the centerline 0' of the workpiece to the workpiece side edge W2, the distance from the centerline 0' of the workpiece to the A-axis of the manipulator is calculated:

$$X=DELSID-LUN/2$$

as shown in FIG. 13*b*.

In step 183, based on the distances XA and X, the manipulator 3 is moved a distance (XA+X) to coincide with the workpiece centerline 0' or the centerline of the dies 0.

In step 183, by means of a previously obtained parameter, the workpiece is rotated and reversed or the like by the drive of the manipulator in the A-, B-, Y-, and Z-axis directions, and is presented to the dies at a specified bending location.

Further, in step 163, in the case where positioning of the workpiece W in the X-axis direction is unnecessary, the program immediately proceeds to step 183 and the manipulator 3 is driven.

From the abovementioned positioning action in the X-axis direction, it is possible to provide a product bent with high precision with an inexpensive manipulator.

In addition, when the workpiece side edge W2 contacts the side sensor 95, the manipulator 3 is stopped close to the center of the range of action of the side sensor 95 so that the workpiece W does not erroneously contact the support member of the side sensor 95.

Next, referring to FIG. 11 and FIG. 19, the process in step 149 for positioning the workpiece W in the Y-axis direction will be explained in detail.

In step 185, a variety of settings are performed to prevent the workpiece W from impacting the back gauge 17 during the previously mentioned positioning action. First, the back gauge 17 is moved in the Y-axis direction by an amount corresponding to the width of the flange to be bent and a space PS (FIG. 11*b*) between the back gauge 17 and the dies 13, 15 is set at a suitable value.

Second, the standard projecting length OFFY (FIG. 11*c*) of the sensor 19 corresponding to the width of the flange to be bent is set at, for example, 10 mm. As outlined below, the workpiece W is positioned in Y-axis direction so that projecting lengths SX, DEX of right and left sensors 19 is equivalent to the abovementioned standard projecting length OFFY. Accordingly, the standard projecting length OFFY is also called the object projecting length hereinafter. The value of the standard projecting length OFFY is stored in the memory device of the numerical control device 21, for example.

The workpiece W then approaches the sensor 19 in the Y-axis direction according to the rule $$Si=\tfrac{1}{2}AT2$$

where Si is the distance from the rear edge of workpiece W to the tip of the sensor 19, A is the acceleration of the manipulator in the Y-axis direction (for example, 1700 mm/sec2), and T is the elapsed time.

In step 187, a check is made to see whether or not the projecting length SX of the left sensor 19 is equivalent to its maximum value SXO (FIG. 11*a*). From this check a judgment is made as to whether or not the rear side of the workpiece W is touching the left sensor 19. If affirmative, the rear side of the workpiece W is not touching the left sensor 19, and the program proceeds to step 189.

In step 189, a check is made to see whether or not the projecting length DEX of the right sensor 19 is equivalent to its maximum value DXO (FIG. 11*a*, FIG. 11*b*). If affirmative, the rear side of the workpiece is not touching the right sensor 19, and the program proceeds to step 191.

In step 191 a check is made to see whether or not the manipulator 3 is fully moved to the rear end in the X-axis direction and its Y coordinate is equivalent to its maximum value YMAX. If affirmative, this means that there is an abnormality. For example, the workpiece W and the sensor 19 have missed each other or the sensor 19 itself is defective. The program therefore proceeds to step 193 and a suitable alarm is given that the bending process has been interrupted.

On the other hand, if a negative decision is obtained in step 191, the program return to step 187 and the previous process is repeated.

If this happens, in due course the rear end on either the right or left side of the workpiece W contacts the sensor 19, and if in either step 187 or step 189 a negative decision is obtained the program proceeds to step 195.

In step 195, the values SX, DEX of the projecting length of the left and right sensors 19 are stored in a suitable memory device.

In step 197, the parameters DIFF, D1, D2, ALFA, and YM which are required for subsequent positioning actions, are calculated.

As shown in FIG. 11*b*, the parameter DIFF is the difference between the projecting lengths SX and DEX of the left and right sensors 19, given by the equation:

$$DIFF=DEX-SX$$

It should be noted that when the workpiece W is inserted between the dies 13, 15 this difference DIFF is not necessarily zero because the positioning precision of the manipulator 3 is not that high. As shown below, by means of the positioning procedures, this difference is made substantially zero, and the rear end of the workpiece is placed parallel to the bending axis C.

As shown in FIG. 11*a*, 11*b*, the parameter D1 is the difference (hereinafter referred to as the spacing) between the standard projecting length OFFY and the current projecting length SX of the left sensor 19, given by the equation:

$$D1=SX-OFFY$$

In the same way, the parameter D2 is the difference between the standard projecting length OFFY and the current projecting length DEX of the right sensor 19, given by the equation:

$$D2=DEX-OFFY$$

Now, the parameter ALFA ($\alpha$) is the tangent of the angle produced when the rear end of the workpiece W is misaligned with respect to the bending axis C of the dies 13, 15, given by the equation:

$$ALFA=DIFF/LUN$$

where LUN is the length of the workpiece W in the direction parallel to the bending axis C. Here it should be noted that the angle of misalignment (i.e. the value of ALFA) is usually small. Accordingly, the parameter ALFA also represents the misaligned angle itself.

The parameter YM is the arithmetical mean of the gaps, D1, D2, given by:

$$YM=(D1+D2)/2$$

In step 199, a check is made to see whether or not the parameter YM is greater than the allowable value YS. If affirmative, the positioning of the workpiece W is insufficient so that program proceeds to step 201 and the counter value K is set to zero.

If a negative decision results in step 199, the program proceeds to step 203 and a check is made to see whether or not the parameter DIFF corresponding to the parameter ALFA is greater than the allowable value DIFFS. If the decision is affirmative the positioning of the workpiece W is insufficient and the program proceeds to step 201, where the counter value K is set to zero, the same way as in step 199.

In step 204, the amount of movement IAY of the workpiece clamping device 45 in the Y-axis direction for moving the workpiece W to the position where the positioning of the workpiece W is made, is calculated by the equation $$IAY=YM\times KGY$$

Here, the coefficient KGY is set at a value smaller than 1, such as ½, ⅓, and the like. For example, if KGY=½, the workpiece clamping device 45 is moved in the Y-axis direction to reduce the spacing YM in half.

In step 205, in the workpiece positioning cycle for bending a specified flange, a check is made to see whether or not this is the first positioning action. If a positive decision is obtained, the program proceeds to step 207, and the amount of movement IY of the workpiece clamping device 45 is determined to be IY=IAY and the program proceeds to step 211.

If a negative determination results in step 205, this means that this step is the second or a subsequent action in the positioning cycle, so the program proceeds to step 209.

Then, the amount of movement IY of the workpiece clamping device 45 is calculated by adding the previous amount of movement IY and the present amount of movement IAY as follows: IY=IY+IAY. Then the program proceeds to step 211.

In step 211 in the same way as before, the new position of the workpiece clamping device 45 is determined to be Y=Y0+IY. Here, Y0 is the original position of the workpiece clamping device 45 at a time when the workpiece W is first inserted between the dies 13, 15.

In steps 213 to 221, positioning calculations similar to those performed in steps 204 to 211 are made to correct the positioning misalignment of the workpiece around the axis A.

Specifically, in step 213, the parameter ALFA is multiplied by a coefficient KGA which is less than 1, and the amount IAA to rotate the workpiece clamping device 45 around the shaft A is calculated as follows:

$$IAA = ALFA \times KGA.$$

In step 215, the determination is made as to whether or not this is the first positioning action around A-axis, concerning a specified flange bending. If positive, the program proceeds to step 217 where the amount of rotation IA of the workpiece clamping device 45 is determined to be IA=IAA. A negative decision in step 215 directs the program to step 219 where the previous amount of rotation IA is added and the present amount of rotation IA is determined to be IA=IA+IAA.

In step 221, the value of IA determined in step 217 or step 219 is added to the original rotational position A0 of the workpiece clamping device 45 to give a new rotational position A:

$$A = A0 + IA$$

In step 223, the workpiece clamping device 45 is moved to position Y in the Y-axis direction determined from steps 204 to 211, and the rotary position A determined from steps 213 to 221 (FIG. 11*b*).

Subsequently, the abovementioned steps are repeated so that the parameters YM, DIFF become smaller than the respective allowable values YS, DIFFS.

When the parameters YM, DIFF become smaller than the respective allowable values YS, DIFFS, the program proceeds from step 203 to step 225.

In step 225, the value of the counter K is incremented and the program proceeds to step 227.

In step 227, a check is made to see whether or not the value of the counter K is equal to a previously set specified value N. If this value has not been reached, the program returns to the loop consisting of the steps 204 to 223, and the abovementioned positioning actions are once again performed.

While these actions are being repeated, the value K in the counter reaches the specified value N, and the program proceeds from 227 to 229, the value K of the counter returns to zero, and the cycle of the workpiece clamping device in the Y-axis direction terminates (FIG. 11*c*).

In the above embodiment of the present invention, because the workpiece W is finally placed in a position separated by OFFY from the back gauge 17, there is no concern that the workpiece W will impact the back gauge 17 during the positioning action.

Moreover, it is possible to end this positioning cycle, for example, in the order of 40/1000 seconds. Also, it is possible to perform the positioning with a precision of about 1/100 mm.

On the other hand, before positioning automatically, it is necessary to adequately compensate for the offset of the sensor 19 in the same way as for other equipment.

As can be understood from the foregoing explanation, in the present invention, because the manipulator is driven and controlled by means of the signal from the action of positioning the workpiece, a high precision bending process can be performed by a manipulator which itself does not have a high degree of positioning precision.

As a result it is possible to construct a relatively inexpensive manipulator.

What is claimed is:

1. A method of bending a sheet workpiece having a long edge and a short edge by means of a press brake which includes:

a pair of dies having a longitudinal axis and being capable of acting in mutual cooperation to bend a workpiece having edges;

a manipulator for handling the workpiece;

detector means, mounted on a frame of the press brake, for detecting the workpiece position along the longitudinal axis of the dies; the method comprising the steps of:

(a) bending the short edge of the workpiece between the pair of dies;

(b) rotating the workpiece by means of the manipulator so that the long edge of the workpiece faces the dies;

(c) moving the workpiece by means of the manipulator toward the detector means;

(d) detecting the workpiece position along the longitudinal axis of the dies by means of the detector means;

(e) moving the workpiece by means of the manipulator along the longitudinal axis of the dies;

(f) detecting a distance moved by the manipulator;

(g) positioning the workpiece at a suitable position with respect to the dies along the longitudinal axis of the dies, based on the workpiece position detected at the step (d) and the distance moved by the manipulator detected at the step (f); and (h) bending the long edge of the workpiece between the pair of dies.

2. A bending press system, comprising:

a bending press having an elongated punch and an elongated die which cooperate with each other for performing a bending operation in a workpiece that is provided therebetween, said punch and die having a longitudinal axis extending in an X-axis direction;

a manipulator provided in front of the punch and the die, for providing the workpiece between the punch and the die for the bending operation, the manipulator being movable in the X-axis direction while gripping the sheet workpiece;

a lateral gauge means provided on a frame of the bending press, for detecting a position of the workpiece in the X-axis direction;

means for detecting the distance moved by the manipulator in the X-axis direction; and control means connected to the lateral gauge means and the distance moved detection means, for controlling the movement of the manipulator, the control means calculating the position in the X-axis direction of the workpiece, based upon signals from the lateral gauge means and the distance moved detection means, and controlling the manipulator so as to position the workpiece at a suitable position with respect to the punch and the die in the X-axis direction.

3. A method of positioning a sheet workpiece with respect to a press brake which includes:

a pair of dies having a longitudinal axis and being capable of acting in mutual cooperation to bend the sheet workpiece;

a manipulator for gripping the workpiece, the manipulator being movable along the longitudinal axis of the dies;

detector means mounted on a frame of the press brake, for detecting a workpiece position along the longitudinal axis of the dies;

the method comprising the steps of:

(a) gripping the sheet workpiece by the manipulator;

(b) moving the workpiece by the manipulator along the longitudinal axis of the dies toward the detector means;

(c) detecting the workpiece position along the longitudinal axis of the dies by the detector means;

(d) moving the workpiece by the manipulator along the longitudinal axis of the dies away from the detector means;

(e) detecting the distance moved by the manipulator;

(f) positioning the workpiece at a suitable position with respect to the dies along the longitudinal axis of the dies, based upon the workpiece position detected at the step (c) and the distance moved by the manipulator detected at the step (e).

* * * * *